US008781913B1

(12) United States Patent
Murray

(10) Patent No.: US 8,781,913 B1
(45) Date of Patent: Jul. 15, 2014

(54) SYSTEM AND METHOD FOR CONDUCTING AN ONLINE AUCTION VIA A SOCIAL NETWORKING FORUM

(71) Applicant: Wingit IT, LLC, Germantown, MD (US)

(72) Inventor: Steven Randall Murray, Germantown, MD (US)

(73) Assignee: Wingit IT, LLC, Germantown, MD (US)

( * ) Notice: Subject to any disclaimer, the term of this patent is extended or adjusted under 35 U.S.C. 154(b) by 0 days.

(21) Appl. No.: 13/933,066

(22) Filed: Jul. 1, 2013

(51) Int. Cl.
*G06Q 30/00* (2012.01)

(52) U.S. Cl.
USPC ..... 705/26.3

(58) Field of Classification Search
USPC ..... 705/26.1, 27.1, 26.3, 14.71, 319
See application file for complete search history.

(56) References Cited

U.S. PATENT DOCUMENTS

| | | | | |
|---|---|---|---|---|
| 8,284,748 | B2 | 10/2012 | Borghei | 370/338 |
| 2002/0032634 | A1* | 3/2002 | Abrams et al. | 705/37 |
| 2005/0076078 | A1 | 4/2005 | Salton | 709/201 |
| 2006/0184443 | A1* | 8/2006 | Erez et al. | 705/37 |
| 2008/0091445 | A1 | 4/2008 | Mihic | 705/1 |
| 2009/0048927 | A1 | 2/2009 | Gross | 705/14 |
| 2009/0307003 | A1 | 12/2009 | Benyamin et al. | 705/1 |
| 2011/0016399 | A1 | 1/2011 | Yasrebi et al. | 715/734 |
| 2011/0153740 | A1 | 6/2011 | Smith et al. | 709/204 |
| 2011/0161130 | A1 | 6/2011 | Whalin et al. | 705/7.18 |
| 2011/0238755 | A1 | 9/2011 | Khan et al. | 709/204 |
| 2011/0289433 | A1 | 11/2011 | Whalin et al. | 715/753 |
| 2012/0084169 | A1* | 4/2012 | Adair et al. | 705/26.3 |
| 2012/0179980 | A1* | 7/2012 | Whalin et al. | 715/753 |
| 2012/0179981 | A1 | 7/2012 | Whalin et al. | 715/753 |
| 2012/0290950 | A1 | 11/2012 | Rapaport et al. | 715/753 |
| 2012/0311037 | A1 | 12/2012 | Sivasubramaniam et al. | 709/204 |
| 2012/0323689 | A1 | 12/2012 | Metcalf et al. | 705/14.58 |
| 2012/0324018 | A1 | 12/2012 | Metcalf et al. | 709/206 |
| 2013/0073473 | A1 | 3/2013 | Heath | 705/319 |
| 2013/0097246 | A1 | 4/2013 | Zifroni et al. | 709/204 |
| 2013/0124356 | A1* | 5/2013 | Bhogal et al. | 705/26.3 |
| 2013/0212494 | A1 | 8/2013 | Heiferman, et aL | 715/753 |
| 2013/0219298 | A9 | 8/2013 | Whalin et al. | 715/753 |

OTHER PUBLICATIONS

Gayatri Swamynathan, Do social networks improve e-commerce?: a study on social marketplaces. In Proceedings of the first workshop on Online social networks (WOSN 2008). ACM, New York, NY, USA, 1-6.*

* cited by examiner

*Primary Examiner* — Matthew Zimmerman
(74) *Attorney, Agent, or Firm* — Pillsbury Winthrop Shaw Pittman LLP

(57) ABSTRACT

The invention relates to a system and method for conducting an online auction via a social networking forum for a cohort of users that have a pre-established association with an experience scheduled to occur at a predetermined time, a predetermined date and a predetermined location. The system may provide a social networking forum that facilitates social networking communications amongst members of the forum combined with auction capabilities that provide items that may be relevant to its members. Users in the cohort may join the social networking forum as members. The social networking forum may provide a supplier of an item for auction with a target audience that may be interested in the item by virtue of their pre-established association with an experience. Similarly, from the perspective of a member of the forum, the system may provide an auction that includes items that may be of interest to the member.

30 Claims, 5 Drawing Sheets

SYSTEM AND METHOD FOR CONDUCTING AN ONLINE AUCTION VIA A SOCIAL NETWORKING FORUM

FIELD OF THE INVENTION

The invention relates to a system and method for conducting an online auction via a social networking forum for a cohort of users that that have a pre-established association with an experience scheduled to occur at a predetermined time, a predetermined date, and a predetermined location.

BACKGROUND OF THE INVENTION

Generally speaking, individuals often provide items for sale via online auction systems. Conventional online auction systems may conduct an electronic auction of the item on behalf of a provider (e.g., a seller) of the item. For example, an online auction system may make the item available for bidding by members of the general public and facilitate provision of the item from the provider and a winning bidder.

Conventional online auction systems have various limitations and drawbacks. For example, an individual supplying an item for auction may be unable to identify other individuals who may want the item and notify them that the item is available via the online auction system. Similarly, an individual who is interested in acquiring a particular item or perusing potential items of interest that are relevant to the individual may have to search a conventional online auction system and possibly wade through irrelevant items to determine whether the particular item is available or otherwise find potential items of interest.

Further, conventional online auction systems do not provide enough control over the individuals who may participate in the auction. For example, while some online auction systems may allow the individual providing the item to block particular individuals from participating in the auction, they typically do not facilitate targeting potentially interested individuals to participate in the auction.

Conventional online auction systems suffer from these and other drawbacks.

SUMMARY OF THE INVENTION

The invention solving these and other drawbacks of conventional systems relates to a system and method for conducting an online auction via a social networking forum for a cohort of users that have a pre-established association with an experience scheduled to occur at a predetermined time, a predetermined date and a predetermined location. For example, a system may be configured to provide a social networking forum that facilitates social networking communications amongst the members of the forum combined with auction capabilities that provide items that may be relevant to its members. The social networking forum may be available for users in the cohort to join as members. As such, the members of the social networking forum have a pre-established association with one another because they are scheduled to share the same experience.

The social networking forum may provide a supplier of an item for auction with a target audience (e.g., members of a forum) that may be interested in the item by virtue of their pre-established association with an experience. Similarly, from the perspective of a given member of the forum, the system may provide an auction that includes items that may be of interest to the given member. For example, an airline may supply items for auction via a social networking forum for passengers scheduled on one of the airline's flights. The supplied items may include items that would be relevant to the passengers of the flight such as, for example, an upgraded seat, a meal voucher, earphones, entertainment, and/or other products and/or services that may be of interest to a passenger of the flight.

The system may be configured to receive an identification of an item to be auctioned from various suppliers. A supplier may include a provider of the experience, a member of the forum, a third party who has access to the social networking forum, and/or other entities. For example, the system may receive, from the supplier, auction identification information that includes the identification of the item and/or parameters by which to conduct the auction. In some implementations, the system may receive an identification of members who should be included as a participant in the auction. In this manner, the supplier may identify and/or target members who should be offered a chance to participate in the auction.

The system may be configured to receive from a member a specification of one or more conditions that, when satisfied, alert the member that a given item is to be auctioned. The one or more conditions may identify a particular item, a type of item, and/or other condition that may be specified by the member. In other words, the conditions may serve as a wish list of one or more items and/or features of an item. In this manner, when an item is up for auction that satisfies the conditions, the member may be notified.

The system may provide a notification to the members of the forum that may participate in the auction that the item will be auctioned. The notification may be provided via the social networking forum and/or other communication channels. The system may conduct the auction on behalf of the supplier by receiving bids and determining a winning bid or that no winning bid has been received. The system may facilitate the provision of the item by the supplier in relation to the winning bid and/or payment from the winning bidder to the supplier. Throughout the auction and/or afterward, the system may provide notifications via the social networking forum to the members of the forum that may be participating in the auction to provide status updates related to the auction.

In some implementations, a provider of the shared experience may manage the social networking forum for the cohort of users and/or the auction capabilities of the social networking forum. For example, a provider may restrict participation by other suppliers in the social networking forum. The system may allow a provider to restrict which entities may supply items to be auctioned, may restrict the items offered for auction via the social networking forum, may restrict the manner in which the auction is conducted, may restrict the manner in which the item is provided from the supplier to the winning bidder, and/or may provide other restrictions related to the auction of items via the social networking forum.

Various entities interacting with the system may benefit. A supplier of a given item may benefit by leveraging a given social networking forum to target items to be auctioned to particular members who may be interested in the item. Because the given social networking forum is related to a shared experience, at least some of the members of the forum may share similar interests or otherwise have a shared interest in the given item because of its relation to the shared experience. Furthermore, a supplier may identify particular members or groups of members who should be able to participate in the auction, thereby exercising enhanced control over the auction.

A member who wishes to bid on an auction item may benefit by being provided with notifications of items to be auctioned that may be relevant to the member and/or searching items to be auctioned that are related to the social networking forum, instead of having to wade through several items that may not be of interest to the member. Furthermore, the member who wishes to bid on the auction item may have enhanced communication capabilities before, during, and/or after the auction with the supplier of the auction item and other members who wish to bid on the auction item.

A provider of the shared experience (who may also be the supplier of an auction item) may benefit from using the system by leveraging the communication and auction capabilities to provide a more complete experience for its patrons. For example, a provider of the shared experience may partner with or otherwise provide the system to its patrons so that the patrons may be able to sell and/or buy items that may be related to the shared experience.

The system for conducting an online auction via a social networking forum for a cohort of users may comprise a computing device including a physical processor configured to perform some or all of a functionality of a plurality of modules. In some implementations, the computing device may comprise a non-transitory, tangible computer-readable storage medium with an executable program stored thereon, wherein the program instructs a microprocessor to perform some or all of the functionality of the plurality of modules. The plurality of modules may include, for example, a forum management module, an auction submission module, an auction management module, a provider management module, a third party management module, a role-based permissions module, a storage module, a reporting module, and/or other modules.

The forum management module may be configured to provide a social networking forum for the cohort and facilitate social networking communications between one or more members of the forum. The auction submission module may be configured to receive auction identification information for an item for auction. The auction management module may be configured to conduct an auction of an item via the forum by presenting items for auction and facilitating bidding and winning an auction item by one or more members of the forum. The provider management module may be configured to facilitate registration of a provider of a shared experience, facilitate management of an auction by the provider, and/or other functionality related to managing the shared experience. The third party management module may be configured to facilitate registration of third parties with the system, provide an interface for third parties to present content to a forum, facilitate management of an auction by a third party, and/or otherwise manage the access of third parties to members and/or content of the forum. The role-based permission module may be configured to tailor access to the system based on roles of various users including, for example, a role in the system, a role in a cohort, a role in an auction, and/or other roles. The storage module may be configured to store information related to system usage, one or more cohorts, one or more forums, one or more auctions, and/or other information related to the system. The reporting module may be configured to facilitate analysis and report information related to system usage, one or more cohorts, one or more forums, one or more auctions, and/or other information related to the system.

The forum management module may be configured to provide a plurality of social networking forums for a respective plurality of cohorts. The forum management module may allow a user of a cohort to join a social networking forum for the cohort as a member of the forum. A cohort of users may comprise, for example, one or more persons that have a pre-established association with an experience scheduled to occur at a predetermined time, a predetermined date, and a predetermined location. Experiences may include taking a same flight, taking a same bus, taking a same train, attending a same sporting event, attending a same concert, attending a same play, attending a same art show, attending a same exhibition, attending a launch of a same product (e.g., a movie, an electronic gadget, and/or other product) and/or other shared experience between a plurality of persons that is scheduled to occur at a predetermined time, a predetermined date, and a predetermined location. A user may be associated with an experience by buying a ticket for the experience, registering for the experience, and/or otherwise performing an action that indicates that the user plans to engage in the experience.

A cohort may be identified by a unique identifier, which may include a human-readable identifier and/or other type of identifier. For an individual cohort, the forum management module may be configured to store the unique identifier, an identification of the experience shared by the users of the cohort, a predetermined time at which the experience is expected to occur, a predetermined date on which the experience is expected to occur, a predetermined location at which the experience is expected to occur, a type of the experience, a sub-type of the experience, one or more users of the cohort, contact information for one or more users of the cohort, a set of authorized users for the cohort, information related to a provider of the shared experience, and/or other information related to the cohort. A type of experience may comprise, for example, transportation, sporting event, entertainment event, family event, art event, and/or other type of shared experience between a plurality of persons with a pre-established connection to the experience that is scheduled to occur at a predetermined time, a predetermined date and a predetermined location. A type of experience may include a plurality of sub-types, where the sub-types are delineated by one or more values associated with a set of one or more respective items of related information.

The forum management module may facilitate social networking communications between one or more members of a social networking forum. For example, the forum management module may facilitate sharing items of content via the social networking forum. In some implementations, one or more identifiers may be associated and/or included with an item of content. An identifier may identify, for example, a member of the forum, a time, a place, a location, another forum, a third party identifier, a social media tag, and/or other identifier for the item of content. In some implementations, the member sharing the content with the forum may indicate that some or all portions of the item of content should be shared, may indicate whether the content may be shared to the general public, may indicate other members of the forum with whom the portions of the item are shared, and/or may otherwise restrict sharing of the item of content. In some implementations, the forum management module may facilitate the sharing of at least some of the content items over one or more social media platforms. In some implementations, the forum management module may allow a member to tag or link an entity such as a person, place, and/or location to an item of content.

The auction submission module may be configured to receive auction identification information for an item for auction. The auction identification information may include an identification of the item, a minimum bid for the item, information related to the supplier of the item, information related to one or more end conditions which, when met, end the auction, information related to a date and/or time at which to begin the auction, a type of auction, and/or other parameters by which to conduct the auction. For example, a type of auction may comprise an auction in which the highest bid wins, an auction in which the lowest bid wins, a dutch auction, a sealed bid auction, a vickrey auction, an auction with a 'buy now' option, and/or other type of auction. Information related to end conditions which might end the auction may comprise, for example, a predetermined time period after which the auction begins, a predetermined time period after a bid is received without a subsequent bid being received, an occurrence of the shared experience of the cohort, a loss of value of the item, and/or other information related to one or more conditions which may end an auction. In some implementations, the auction submission module may receive an identification of members who should be included as a participant in the auction.

In some implementations, the auction submission module may impose restrictions on an auction of an item. The auction submission module may receive the restrictions from a provider of the shared experience who may manage the forum, from a system administrator, and/or another entity able to control an auction conducted via the forum. A restriction may regulate an item supplied, a type of item, a quantity of item, a time and/or date of the auction for an item, and/or other parameter of the auction. In some implementations, a provider of the shared experience may be able to supply a same or different set of restrictions than another entity able to control an auction conducted via the forum.

Based on the received auction information, the auction submission module may generate an identifier for the auction. For example, the auction submission module may be configured to generate an identifier for the auction based on one or more of an identifier for the item being auctioned, a time and/or date on which the auction is to be conducted, a supplier of the item for auction, and/or other information related to the auction for the item.

One or more types of suppliers may provide an item for auction and auction information. A type of supplier may be a member of the forum, a provider of the shared experience, a third party with access to the social networking, and/or other type of entity that provides the item. In some implementations, a supplier may determine relevant and/or timely items to provide for auction to members of the forum based on the shared experience.

Responsive to the auction submission module receiving auction information and generating a unique identifier for the auction, the auction management module may be configured to conduct an auction for the item. The auction management module may be configured to conduct an auction by presenting items for auction and facilitating bidding and winning an auction item by one or more members of the forum. The auction may be conducted by performing one or more auction events via the social networking forum. Auction events may comprise, for example, receiving auction information to begin an auction, providing notification via the forum that an item is available for auction, providing notification via the forum that one or more bids for auction have been received, ending the auction, awarding the item to a winning bidder, and/or other events related to an auction.

The auction may be conducted as part of a content feed of the social networking forum or separate from the content feed. The content feed may comprise a communication channel via which members of the forum post information to be shared. In some implementations, some of the auction events may be shared via the content feed of the forum (e.g., providing notifications, ending the auction, and/or other auction events that involve more than one member), while other auction events may be conducted separately from the content feed (e.g., receiving auction information, awarding the item, and/or other auction events that involve only one member).

In some implementations, the auction management module may comprise an auction initiation module, a bid management module, an auction ending module, an award management module, and/or other computer program modules related to conducting an auction. The auction initiation module may initiate an auction responsive to the auction submission module receiving auction information and generating a unique identifier for the auction. The bid management module may be configured to receive bids from one or more members, facilitate communication during the auction, and/or otherwise manage bidding in the auction. The auction ending module may be configured to end the auction based on one or more end conditions for the auction being met. The award management module may be configured to facilitate provision of the item to the member who won the auction, facilitate return the item to the supplier responsive to no bids being received during the auction, and/or otherwise manage the provision of the item at the end of the auction.

The auction initiation module may initiate an auction responsive to the auction submission module receiving auction information and generating a unique identifier for the auction. In some implementations, the auction initiation module may be configured to set a time limit, identify one or more accepted types of presenters of an auction item (e.g., a member of the forum, an administrator of the system, a third party, a provider of the shared experience, and/or other author), identify one or more accepted types of bidders (e.g., a member of the forum, an administrator of the system, a third party, a provider of the shared experience, and/or other author), identify a delivery method of the auction item, set a minimum bid, set a maximum bid, set a maximum number of bids per member, and/or other set other restrictions related to the auction. One or more values for the restrictions may be default values. The auction initiation module may be configured to revise a value for a restriction responsive to receiving input related to the restriction from the supplier of the item for auction.

The auction initiation module may associate some or all of the members of the forum with the auction. The auction initiation module may select one or more members to associate with the auction based on preferences of the supplier of the item for auction, preferences of individual members of the cohort, and/or based on other information relating to the auction. For example, the supplier may specify one or more members of the forum to be notified of the auction. In another example, one or more members of the forum may indicate that they want to be notified of an auction occurring, of an auction for a type of item, of an auction for a particular item, of an auction for an item provided by a type of supplier, of an auction for an item provided by a particular supplier, and/or of an auction that meets one or more other conditions.

In some implementations, the auction initiation module may notify the members of the forum of the initiation of the auction via the content feed of the social networking forum or via a communication channel of the forum separate from the content feed. Responsive to the auction initiation module associating a subset of members of the forum with the auction, where the subset comprises less than all of the members of the forum, the auction initiation module may send a private chat message to individual members being notified.

The bid management module may be configured to receive bids from one or more members, facilitate communication during the auction, and/or otherwise manage bidding in the auction. The bid management module may be configured to manage bids based on the type of auction being conducted.

The bid management module may be configured to display the best bid received during the auction (or the minimum bid, if no bids have been received). The bid management module may also be configured to display information related to the member that submitted the best bid, a time left for bidding, a time left for the auction, a supplier of the item for auction, and/or other information related to the auction. Responsive to receiving a bid from a member of the forum, the bid management module may determine whether the received bid is better than the current best bid received (or the minimum bid, if no bids have been received) based on the type of auction being conducted. Responsive to determining that the received bid is better, the bid management module may update the current best bid received and/or the member with the current best bid.

The bid management module may also be configured to facilitate chat communications between members for the auction. In some implementations, the bid management module may provide a separate communication channel via the forum for the auction, using which members participating in the auction may engage in social networking communications.

The auction ending module may be configured to end the auction based on one or more end conditions for the auction being met. End conditions may comprise, for example, a predetermined time period after which the auction begins, a predetermined time period after a bid is received without a subsequent bid being received, an occurrence of the shared experience of the cohort, a loss of value of the item, and/or other information related to one or more conditions which may end an auction. The auction ending module may monitor the auction to determine whether one or more of the end conditions are met. In some implementations, auction ending module may be configured to provide an alert to the members that satisfaction of an end condition is imminent (e.g., the auction will end soon). For example, an end condition may specify that when a given bid is received and no subsequent bid is received within a predetermined time period, the auction will terminate and the given bid will be deemed the winning bid. In the foregoing example, the auction ending module may provide an alert to the members participating in the auction at a predefined alert time before the end condition is met. The alert may indicate that the auction will end at the predetermined time unless a subsequent bid is received. The auction ending module may provide the alert in a same or similar way that the auction provides notifications to the members participating in the auction.

The award management module may be configured to cause the item to be provided to the member who won the auction, cause the item to be returned to the supplier responsive to no winning or otherwise successful bids being received during the auction, and/or otherwise manage the provision of the item at the end of the auction. Responsive to the auction ending (e.g., one or more of the end conditions of the auction being met, and/or other ending of the auction), the award management module may determine whether any bids were received during the auction. Responsive to one or more bids being received, the award management module may provide the supplier with information relating to the member that submitted the bid that won the auction and may facilitate provision of the item to the member that submitted the bid that won the auction. In some implementations, the auction identification information associated with the item may specify how the item is provided. In some implementations, the award management module may facilitate communication between the member with the winning bid and the supplier to decide delivery terms. The award management module may also facilitate payment for the item by the member with the winning bid.

The provider management module may be configured to facilitate registration of a provider of a shared experience, facilitate management of an auction by the provider, and/or other functionality related to managing the shared experience. The provider management module may be configured to allow a provider of a shared experience to control access and participation by members, third parties, administrators of the system, and/or other individuals in the auction.

The provider management module may also be configured to allow a provider to restrict the auctions available via the forum. For example, the provider management module may be configured to allow a provider to authorize auctions for particular types of items, for particular items, from particular third parties, from particular members of the forum, and/or auctions with other characteristics. The provider management module may be configured to receive one or more restrictions for auctions conducted via the forum. For example, the provider management module may be configured to receive restrictions on: an item that may be provided, the type of item that may be provided, who may access the forum, who may access the auction, a time and/or date on which the auction may be conducted, delivery terms for the item, and/or other restrictions related to an auction.

In some implementations, a same provider may be associated with a plurality of shared experiences (and a plurality of respective cohorts). The provider management module may be configured to allow a provider to manage some or all associated auctions in a same way or on a case-by-case individual basis. For example, the restrictions provided may vary based on depending on type of supplier, particular supplier, cohort, and/or other entity involved with the auction or the forum. Examples of providers include airports, airlines, transportation companies, entertainment venues, sports arenas, sports leagues, and/or other entities that provide shared experiences.

The third party management module may be configured to facilitate registration of third parties with the system, facilitate management of an auction by a third party, and/or otherwise manage the access of third parties to members and/or the auction. In some implementations, the third party management module may be configured to allow a third party to submit an item for auction in a forum. In some implementations, the third party management module may be configured to allow a third party to participate in an auction in a manner the same or similar to a member of the forum. In some implementations, the third party management module may be configured to restrict participation by a third party in a forum. The third party management module may be configured to require a third party to pay a transaction fee for access to the system, for particular types of access to a forum, to provide an item for auction, to bid on an item in an auction, and/or for other types of participation in the auction.

The role-based permission module may be configured to tailor access to the system based on roles of various users including, for example, a role in the system, a role in a forum, a role as a third party, a role as a provider of the shared experience, a role in an auction, and/or other roles. The one or more roles may include system-level roles, forum-level roles, auction-level roles, third party level roles, and/or other types of roles. System-level roles may grant access to various system features such as for example, access to one or more modules, access to content stored at a storage module, and/or other access to system features. System-level roles may be configured, for example, to manage storage of forum information, access to third parties, and/or other system-level features. Different system-level roles may be granted that provide access to different system features. Forum-level roles may grant access to various forum features such as, for example, access to the content shared by the forum, access to contact information of members of the forum, access to auctions conducted via the forum, and/or other access. Different forum-based roles may be granted that provide access to different forum features. Auction-level roles may grant access to various forum features such as, for example, access to an auction, access to bid on an item in an auction, access to communicate with a supplier and/or other members participating in an auction, access to the content shared via a communication channel for an auction, and/or other access. Different auction-based roles may be granted that provide access to different auction features. The role-based permissions module may maintain a plurality of roles, including, for example, administrator, member, third party, provider of shared experience, and/or other roles.

The storage module may be configured to store information related to system usage, one or more cohorts, one or more forums, one or more auctions, and/or other system information. For example, the storage information may be configured to store information related to cohorts, forums, auctions, third parties, and/or other information obtained, accessed, and/or processed via the system. The storage module may further store content developed and/or shared via the system.

The reporting module may be configured to facilitate analysis and report information related to system usage, one or more cohorts, one or more forums, one or more auctions, and/or other system information. The reporting module may also be configured to prepare and/or display statistics and/or reports regarding the information related to system usage, cohort information, forum content, auction content, third party access, and/or other information obtained, accessed, and/or processed by the system. For example, the reporting module may prepare and/or display a report describing average selling price for items auctioned via a forum.

These and other aspects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
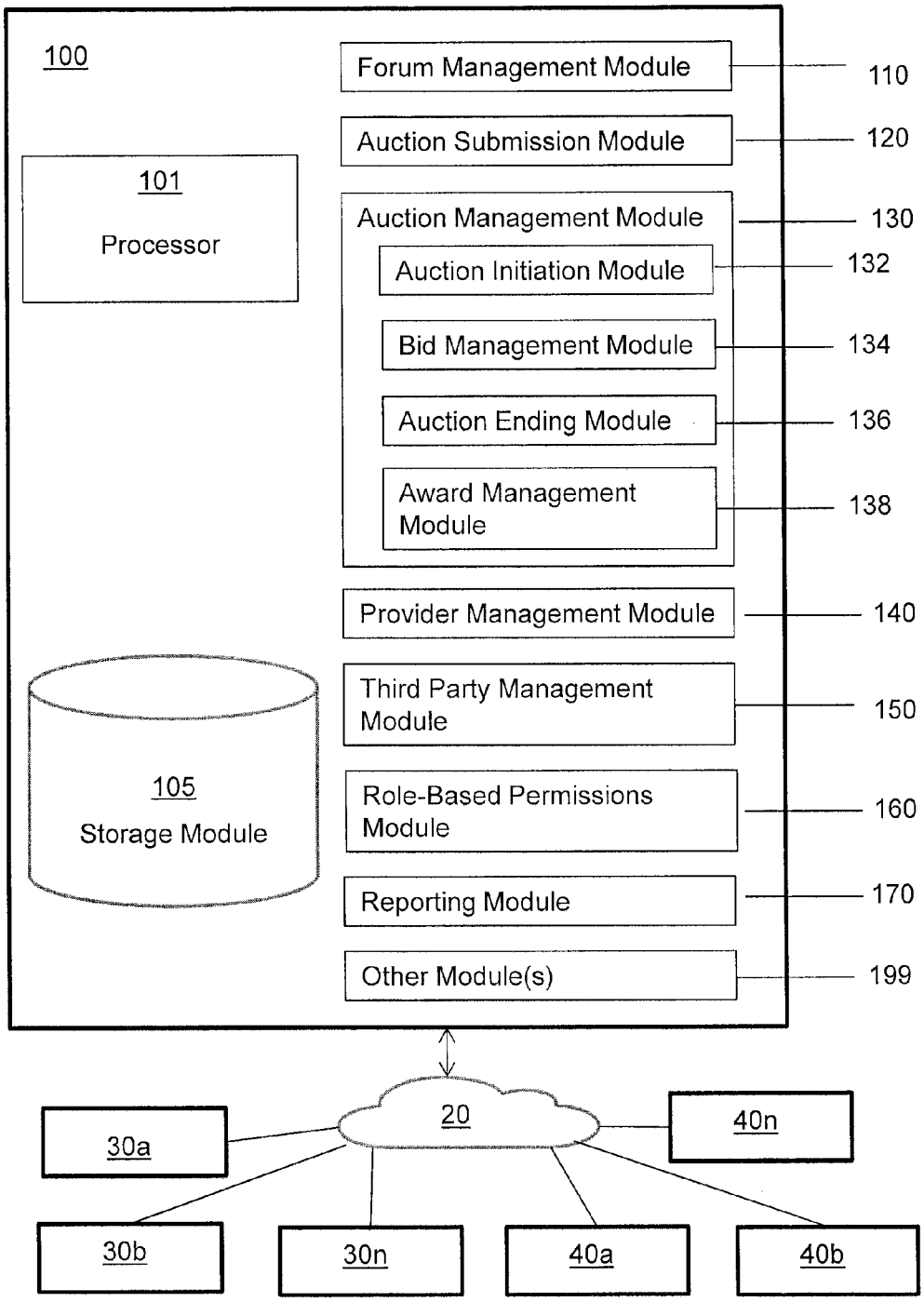
FIG. 1 illustrates a block diagram of an exemplary system for conducting an auction via social networking forum for a cohort of users, according to various implementations of the invention.

FIG. 1 illustrates a diagram of a system 10 for conducting an auction via social networking forum for a cohort of users, according to an implementation of the invention. The system 10 may include a network 20, a computing device 100, one or more user computing devices 30*a*, 30*b*, . . . , 30*n*, one or more provider computing devices 40*a*, 40*b*, . . . , 40*n*, and/or other components. The computing device 100 may include a processor 101 configured to perform some or all of a functionality of a plurality of modules. In some implementations, the computing device 100 may comprise a non-transitory, tangible computer-readable storage medium with an executable program stored thereon, wherein the program instructs a microprocessor to perform some or all of the functionality of the plurality of modules. The plurality of modules may include, for example, forum management module 110, an auction submission module 120, an auction management module 130, a provider management module 140, a third party management module 150, a role-based permissions module 160, a storage module 105, a reporting module 170, and/or other modules. The system 10 may be configured to provide a social networking forum that facilitates social networking communications amongst the members of the forum combined with auction capabilities that provide items that may be relevant to its members. The social networking forum may be available for users in a cohort to join as members. As such, the members of the social networking forum have a pre-established association with one another because they are scheduled to share the same experience.

The forum management module 110 may be configured to provide a social networking forum for the cohort and facilitate social networking communications between one or more members of the forum. The auction submission module 120 may be configured to receive auction identification information for an item for auction. The auction management module 130 may be configured to conduct an auction of an item via the forum by presenting items for auction and facilitating bidding and winning an auction item by one or more members of the forum. The provider management module 140 may be configured to facilitate registration of a provider of a shared experience, facilitate management of an auction by the provider, and/or other functionality related to managing the shared experience. The third party management module 150 may be configured to facilitate registration of third parties with the system, provide an interface for third parties to present content to a forum, facilitate management of an auction by a third party, and/or otherwise manage the access of third parties to members and/or content of the forum. The role-based permission module 160 may be configured to tailor access to the system based on roles of various users including, for example, a role in the system, a role in a cohort, a role in an auction, and/or other roles. The storage module 105 may be configured to store information related to system usage, one or more cohorts, one or more forums, one or more auctions, and/or other information related to the system. The reporting module 170 may be configured to facilitate analysis and report information related to system usage, one or more cohorts, one or more forums, one or more auctions, and/or other information related to the system.

The forum management module 110 may be configured to provide a plurality of social networking forums for a respective plurality of cohorts. The forum management module 110 may allow a user of a cohort to join a social networking forum for the cohort as a member of the forum. A cohort of users may comprise, for example, one or more persons that have a pre-established association with an experience scheduled to occur at a predetermined time, a predetermined date, and a predetermined location. Experiences may include taking a same flight, taking a same bus, taking a same train, attending a same sporting event, attending a same concert, attending a same play, attending a same art show, attending a same exhibition, attending a launch of a same product (e.g., a movie, an electronic gadget, and/or other product) and/or other shared experience between a plurality of persons that is scheduled to occur at a predetermined time, a predetermined date, and a predetermined location. A user may be associated with an experience by buying a ticket for the experience, registering for the experience, and/or otherwise performing an action that indicates that the user plans to engage in the experience.

A cohort may be identified by a unique identifier, which may include a human-readable identifier and/or other type of identifier. For an individual cohort, the forum management module 110 may be configured to store the unique identifier, an identification of the experience shared by the users of the cohort, a predetermined time at which the experience is expected to occur, a predetermined date on which the experience is expected to occur, a predetermined location at which the experience is expected to occur, a type of the experience, a sub-type of the experience, one or more users of the cohort, contact information for one or more users of the cohort, a set of authorized users for the cohort, information related to a provider of the shared experience, and/or other information related to the cohort. A type of experience may comprise, for example, transportation, sporting event, entertainment event, family event, art event, and/or other type of shared experience between a plurality of persons with a pre-established connection to the experience that is scheduled to occur at a predetermined time, a predetermined date and a predetermined location. A type of experience may include a plurality of sub-types, where the sub-types are delineated by one or more values associated with a set of one or more respective items of related information.

The forum management module 110 may facilitate social networking communications between one or more members of a social networking forum. For example, the forum management module 110 may facilitate sharing items of content via the social networking forum. In some implementations, one or more identifiers may be associated and/or included with an item of content. An identifier may identify, for example, a member of the forum, a time, a place, a location, another forum, a third party identifier, a social media tag, and/or other identifier for the item of content. In some implementations, the member sharing the content with the forum may indicate that some or all portions of the item of content should be shared, may indicate whether the content may be shared to the general public, may indicate other members of the forum with whom the portions of the item are shared, and/or may otherwise restrict sharing of the item of content.

In some implementations, the forum management module 110 may facilitate the sharing of at least some of the content items over one or more social media platforms. In some implementations, the forum management module 110 may allow a forum member to tag or link an entity such as a person, place, and/or location to an item of content. For example, one or more social media platforms with which a forum member is associated may search for the entity and may present potential entities that match the tagged or linked entity to the forum member. The forum member may share the item of content with one or more of the potential entities. For example, the forum member may share an item of content on a social media page or via a social media account of the potential entity. In another example, the forum management module 110 may facilitate exporting of items of content to a social media platform. For example, the forum management module 110 may facilitate the inclusion of hashtags with content such that the content may be shared via a social media platform such as TWITTER, INSTAGRAM, FACEBOOK, and/or other social media platforms that recognize hashtags.

In some implementations, the forum management module 110 may facilitate creation and management of a forum for a cohort of users in a manner the same or similar to the auctions described in co-pending U.S. patent application Ser. No. 13/933,045 (entitled "System and Method for Creating an Ad Hoc Social Networking Forum for a Cohort of Users", filed Jul. 1, 2013) which is hereby incorporated by reference in its entirety.

The auction submission module 120 may be configured to receive auction identification information for an item for auction. The auction identification information may include an identification of the item, a minimum bid for the item, information related to the supplier of the item, information related to one or more end conditions which, when met, end the auction, information related to a date and/or time at which to begin the auction, a type of auction, and/or other parameters by which to conduct the auction. For example, a type of auction may comprise an auction in which the highest bid wins, an auction in which the lowest bid wins, a dutch auction, a sealed bid auction, a vickrey auction, an auction with a 'buy now' option, and/or other type of auction. Information related to end conditions which might end the auction may comprise, for example, a predetermined time period after which the auction begins, a predetermined time period after a bid is received without a subsequent bid being received, an occurrence of the shared experience of the cohort, a loss of value of the item, and/or other information related to one or more conditions which may end an auction. In some implementations, the auction submission module 120 may receive an identification of members who should be included as a participant in the auction.

In some implementations, the auction submission module 120 may impose restrictions on an auction of an item. The auction submission module 120 may receive the restrictions from a provider of the shared experience who may manage the forum, from a system administrator, and/or another entity able to control an auction conducted via the forum. A restriction may regulate an item supplied, a type of item, a quantity of item, a time and/or date of the auction for an item, and/or other parameter of the auction. In some implementations, a provider of the shared experience may be able to supply a same or different set of restrictions than another entity able to control an auction conducted via the forum.

Based on the received auction information, the auction submission module 120 may generate an identifier for the auction. For example, the auction submission module 120 may be configured to generate an identifier for the auction based on one or more of an identifier for the item being auctioned, a time and/or date on which the auction is to be conducted, a supplier of the item for auction, and/or other information related to the auction for the item.

One or more types of suppliers may provide an item for auction and auction information. A type of supplier may be a member of the forum, a provider of the shared experience, a third party with access to the social networking, and/or other type of entity that provides the item. In some implementations, a supplier may determine relevant and/or timely items to provide for auction to members of the forum based on the shared experience.

Responsive to the auction submission module 120 receiving auction information and generating a unique identifier for the auction, the auction management module 130 may be configured to conduct an auction for the item. The auction management 130 may be configured to conduct an auction by presenting items for auction and facilitating bidding and winning an auction item by one or more members of the cohort. The auction may be conducted by performing one or more auction events via the social networking forum. Auction events may comprise, for example, receiving auction information to begin an auction, providing notification via the forum that an item is available for auction, providing notification via the forum that one or more bids for auction have been received, ending the auction, awarding the item to a winning bidder, and/or other events related to an auction.

The auction may be conducted as part of a content feed of the social networking forum or separate from the content feed. The content feed may comprise a communication channel via which members of the forum post content to be shared. In some implementations, some of the auction events may be shared via the content feed of the forum (e.g., providing notifications, ending the auction, and/or other auction events that involve more than one member), while other auction events may be conducted separately from the content feed (e.g., receiving auction information, awarding the item, and/or other auction events that involve only one member).

In some implementations, the auction management 130 may comprise an auction initiation module 132, a bid management module 134, an auction ending module 136, an award management module 138, and/or other computer program modules related to conducting an auction. The auction initiation module 132 may initiate an auction responsive to the auction submission module receiving auction information and generating a unique identifier for the auction. The bid management module 134 may be configured to receive bids from one or more members, facilitate communication during the auction, and/or otherwise manage bidding in the auction. The auction ending module 136 may be configured to end the auction based on one or more end conditions for the auction being met. The award management module 138 may be configured to facilitate provision of the item to the member who won the auction, facilitate returning the item to the supplier responsive to no bids being received during the auction, and/or otherwise manage the provision of the item at the end of the auction.

The auction initiation module 132 may initiate an auction responsive to the auction submission module receiving auction information and generating a unique identifier for the auction. In some implementations, the auction initiation module 132 may be configured to set a time limit, identify one or more accepted types of presenters of an auction item (e.g., a member of the forum, an administrator of the system, a third party, a provider of the shared experience, and/or other author), identify one or more accepted types of bidders (e.g., a member of the forum, an administrator of the system, a third party, a provider of the shared experience, and/or other author), identify a delivery method of the auction item, set a minimum bid, set a maximum bid, set a maximum number of bids per member, and/or other set other restrictions related to the auction. One or more values for the restrictions may be default values. The auction initiation module 132 may be configured to revise a value for a restriction responsive to receiving input related to the restriction from the supplier of the item for auction.

The auction initiation module 132 may associate some or all of the members of the forum with the auction. The auction initiation module 132 may select one or more members to associate with the auction based on preferences of the supplier of the item for auction, preferences of individual members of the cohort, and/or based on other information relating to the auction. For example, the supplier may specify one or more members of the forum to be notified of the auction. In another example, one or more members of the forum may indicate that they want to be notified of an auction occurring, of an auction for a type of item, of an auction for a particular item, of an auction for an item provided by a type of supplier, of an auction for an item provided by a particular supplier, and/or of an auction that meets one or more other conditions.

In some implementations, the auction initiation module 132 may notify the members of the forum of the initiation of the auction via the content feed of the social networking forum or via a communication channel of the forum separate from the content feed. Responsive to the auction initiation module 132 associating a subset of members of the forum with the auction, where the subset comprises less than all of the members of the forum, the auction initiation module 132 may send a private chat message to individual members being notified.

The bid management module 134 may be configured to receive bids from one or more members, facilitate communication during the auction, and/or otherwise manage bidding in the auction. The bid management module 134 may be configured to manage bids based on the type of auction being conducted. The bid management module 134 may be configured to display the best bid received during the auction (or the minimum bid, if no bids have been received). The bid management module 134 may also be configured to display information related to the member that submitted the best bid, a time left for bidding, a time left for the auction, a supplier of the item for auction, and/or other information related to the auction. Responsive to receiving a bid from a member of the forum, the bid management module 134 may determine whether the received bid is better than the current best bid received (or the minimum bid, if no bids have been received) based on the type of auction being conducted. Responsive to determining that the received bid is better, the bid management module 134 may update the current best bid received and/or the member with the current best bid.

The bid management module 134 may also be configured to facilitate chat communications between members for the auction. In some implementations, the bid management module 134 may provide a separate communication channel for the auction, via which members participating in the auction may engage in social networking communications.

The auction ending module 136 may be configured to end the auction based on one or more end conditions for the auction being met. End conditions may comprise, for example, a predetermined time period after which the auction begins, a predetermined time period after a bid is received without a subsequent bid being received, an occurrence of the shared experience of the cohort, a loss of value of the item, and/or other information related to one or more conditions which may end an auction. The auction ending module 136 may monitor the auction to determine whether one or more of the end conditions are met. In some implementations, auction ending module 136 may be configured to provide an alert to the members that satisfaction of an end condition is imminent (e.g., the auction will end soon). For example, an end condition may specify that when a given bid is received and no subsequent bid is received within a predetermined time period, the auction will terminate and the given bid will be deemed the winning bid. In the foregoing example, the auction ending module 136 may provide an alert to the members participating in the auction at a predefined alert time before the end condition is met. The alert may indicate that the auction will end at the predetermined time unless a subsequent bid is received. The auction ending module 136 may provide the alert in a same or similar way that the auction provides notifications to the members participating in the auction.

The award management module 138 may be configured to cause the item to be provided to the member who won the auction, cause the item to be returned to the supplier responsive to no winning or otherwise successful bids being received during the auction, and/or otherwise manage the provision of the item at the end of the auction. Responsive to the auction ending (e.g., one or more of the end conditions of the auction being met, and/or other ending of the auction), the award management module 138 may determine whether any bids were received during the auction. Responsive to one or more bids being received, the award management module 138 may provide the supplier with information relating to the member that submitted the bid that won the auction and may facilitate provision of the item to the member that submitted the bid that won the auction. In some implementations, the auction identification information associated with the item may specify how the item is provided. In some implementations, the award management module 138 may facilitate communication between the member with the winning bid and the supplier to decide delivery terms. The award management module 138 may also facilitate payment for the item by the member with the winning bid.

The provider management module 140 may be configured to facilitate registration of a provider of a shared experience, facilitate management of an auction by the provider, and/or other functionality related to managing the shared experience. The provider management module 140 may be configured to allow a provider of a shared experience to control access and participation by members, third parties, administrators of the system, and/or other individuals in the auction.

The provider management module 140 may also be configured to allow a provider to restrict the auctions available via the forum. For example, the provider management module 140 may be configured to allow a provider to authorize auctions for particular types of items, for particular items, from particular third parties, from particular members of the forum, and/or auctions with other characteristics. The provider management module 140 may be configured to receive one or more restrictions for auctions conducted via the forum. For example, the provider management module 140 may be configured to receive restrictions on: an item that may be provided, the type of item that may be provided, who may access the forum, who may access the auction, a time and/or date on which the auction may be conducted, delivery terms for the item, and/or other restrictions related to an auction.

In some implementations, a same provider may be associated with a plurality of shared experiences (and a plurality of respective cohorts). The provider management module 140 may be configured to allow a provider to manage some or all associated auctions in a same way or on a case-by-case individual basis. For example, the restrictions provided may vary based on depending on type of supplier, particular supplier, cohort, and/or other entity involved with the auction or the forum. Examples of providers include airports, airlines, transportation companies, entertainment venues, sports arenas, sports leagues, and/or other entities that provide shared experiences.

The third party management module 150 may be configured to facilitate registration of third parties with the system, facilitate management of an auction by a third party, and/or otherwise manage the access of third parties to members and/or the auction. In some implementations, the third party management module 150 may be configured to allow a third party to submit an item for auction in a forum. In some implementations, the third party management module 150 may be configured to allow a third party to participate in an auction in a manner the same or similar to a member of the forum. In some implementations, the third party management module 150 may be configured to restrict participation by a third party in a forum. The third party management module 150 may be configured to require a third party to pay a transaction fee for access to the system, for particular types of access to a forum, to provide an item for auction, to bid on an item in an auction, and/or for other types of participation in the auction.

As mentioned above, a provider of the experience may wish to supply an item to be auctioned using the social networking forum. For example, a shared experience may include a flight, a provider of the experience may include an airline, and the users in the cohort may include passengers of the flight. The system 10 may provide a social networking forum related to the flight, which may be leveraged by the airline to auction an item to the passengers of the flight. The item to be auctioned may be related to the flight such as an item that can be used during or after the flight, an item related to a departure and/or destination location, and/or other item that the airline would like to auction. Through the social networking forum, the system 10 may notify the members of the forum (e.g., one or more of the passengers) that the airline is offering the item for auction and the passengers may place bids on the item through the social networking forum. In some implementations, a supplier may determine relevant and/or timely items to provide for auction to members of the forum based on the shared experience of the cohort of users for which the forum is provided. Accordingly, a supplier may not need to know any information related to individual members of the forum. By providing an item relevant to the shared experience, a supplier may increase the chance that an item will be bought and/or may obtain a higher price for the item compared to an auction available to the general public.

In another example, a third party that has access to the forum may determine an item to supply for auction to members in the forum. In the foregoing example, third parties may comprise, for example, vendors at the departure and/or destination location, hotels at the destination location, rental car entities at the destination location, and/or other third parties that may be related to the some or all of the shared experience. A member of the forum may also determine an item for auction to other members of the forum based on the shared experience. In some implementations, the item supplied for auction by a supplier may not necessarily be related to the shared experience and/or the social networking forum.

The role-based permission module 160 may be configured to tailor access to the system based on roles of various users including, for example, a role in the system, a role in a forum, a role as a third party, a role as a provider of the shared experience, a role in an auction, and/or other roles. The one or more roles may include system-level roles, forum-level roles, auction-level roles, third party level roles, and/or other types of roles. System-level roles may grant access to various system features such as for example, access to one or more modules, access to content stored at a storage module, and/or other access to system features. System-level roles may be configured, for example, to manage storage of forum information, access to third parties, and/or other system-level features. Different system-level roles may be granted that provide access to different system features. Forum-level roles may grant access to various forum features such as, for example, access to the content shared by the forum, access to contact information of members of the forum, access to auctions conducted via the forum, and/or other access. Different forum-based roles may be granted that provide access to different forum features. Auction-level roles may grant access to various forum features such as, for example, access to an auction, access to bid on an item in an auction, access to communicate with a supplier and/or other members participating in an auction, access to the content shared via a communication channel for an auction, and/or other access. Different auction-based roles may be granted that provide access to different auction features. The role-based permissions module 160 may maintain a plurality of roles, including, for example, administrator, member, third party, provider of shared experience, and/or other roles.

The storage module 105 may be configured to store information related to system usage, one or more cohorts, one or more forums, one or more auctions, and/or other system information. For example, the storage information may be configured to store information related to cohorts, forums, auctions, third parties, and/or other information obtained, accessed, and/or processed via the system. The storage module 105 may further store content developed and/or shared via the system.

The reporting module 170 may be configured to facilitate analysis and report information related to system usage, one or more cohorts, one or more forums, one or more auctions, and/or other system information. The reporting module 170 may also be configured to prepare and/or display statistics and/or reports regarding the information related to system usage, cohort information, forum content, auction content, third party access, and/or other information obtained, accessed, and/or processed by the system. For example, the reporting module 170 may prepare and/or display a report describing average selling price for items auctioned via a forum.

Figure 2:
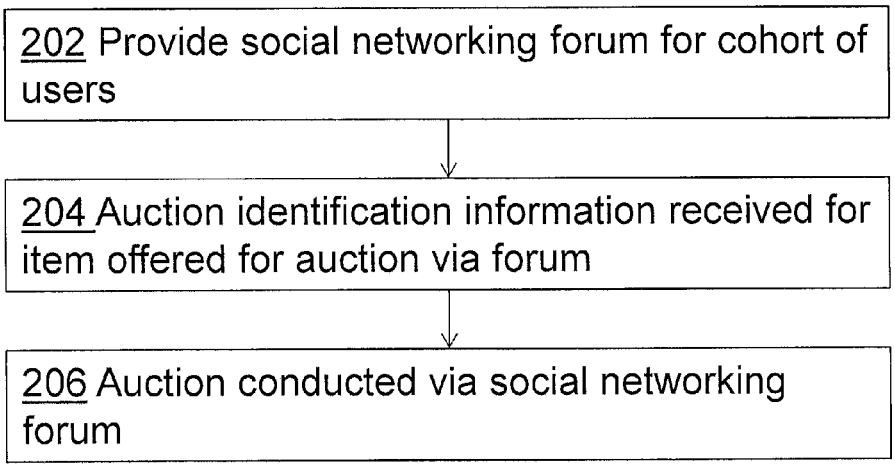
FIG. 2 illustrates a process for conducting an online auction via a social networking forum for a cohort of users, according to various implementations of the invention.

FIG. 2 illustrates a process for facilitating conducting an online auction via a social networking forum for a cohort of users, according to various implementations of the invention.

Figure 3:
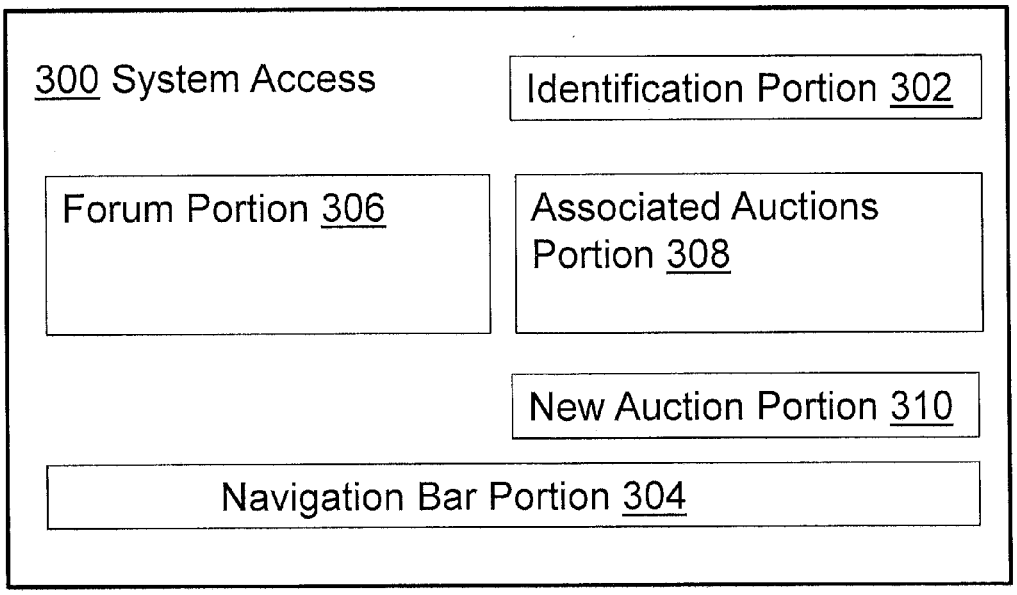
FIG. 3 illustrates an exemplary screenshot of a template by which a user may access the system, according to various implementations of the invention.

FIG. 3 illustrates an exemplary screenshot of a template by which a user may access the system, according to various implementations of the invention. Processing will be described with respect to FIG. 2 in reference to the screen shots illustrated in FIG. 3.

The described operations of FIG. 2 and other figures may be accomplished using some or all of the system components described in detail above and, in some implementations, various operations may be performed in different sequences. In other implementations, additional operations may be performed along with some or all of the operations shown in FIG. 2 and the other figures. In yet other implementations, one or more operations may be performed simultaneously. In yet other implementations, one or more combinations of various operations may be performed. Some implementations may not perform all of the operations described with relation to FIG. 2 and other figures. Accordingly, the operations described are exemplary in nature and, as such, should not be viewed as limiting.

In some embodiments, the operations described in FIG. 2 and the other figures may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations described in FIG. 2 and the other figures in response to instructions stored electronically on an electronic storage medium. The one or more processing devices may include one or more devices configured through hardware, firmware, and/or software to be specifically designed for execution of one or more of the operations described in FIG. 2 and the other figures.

The screenshots illustrated in FIG. 3 and other drawing figures are for illustrative purposes only. Various components may be added, deleted, moved, or otherwise changed so that the configuration, appearance, and/or content of the screenshots may be different than as illustrated in the figures. Accordingly, the graphical user interface objects as illustrated (and described in greater detail below) are exemplary by nature and, as such, should not be viewed as limiting. Interface 300 and other interfaces described herein may be implemented as a web page communicated from computing device 100 to a user computing device (e.g., user computing device 30*a*, 30*b*, . . . , 30*n*), a provider computing device (e.g., provider computing device 40*a*, 40*b*, . . . , 40*n*), an application such as a mobile application executing on a client computing device, provider computing device, and/or other computing device that receives generates the interface based on information communicated from computing device 100, and/or other interface. Whichever type of interface is used, computing device 100 may communicate the data and/or formatting instructions related to the interface to the client, causing the client computing device, provider computing device, and/or other computing device to generate the various interfaces of FIG. 3 and other drawing figures. Furthermore, computing device 100 may receive data from the client computing device, provider computing device, and/or other computing device via the various interfaces, as would be appreciated.

In an operation 202, a social networking forum for a cohort of users may be provided. The forum management module 110 may provide the social networking forum for the cohort of users. The forum management module 110 may provide the social networking forum for the cohort of users in a manner the same or similar as that described above.

In an operation 204, auction identification information for an auction for an item may be received from a supplier. The auction submission module 120 may receive auction identification information for an item offered for auction via the provided social networking forum. The auction submission module 120 may receive auction identification information in a manner the same or similar to that described above.

In an operation 206, an auction may be conducted via the social networking forum. The auction management module 130 may conduct the auction via the social networking forum. The auction management module 130 may conduct the auction in a manner the same or similar to that described above.

FIG. 3 illustrates an exemplary screenshot of an interface 300 that includes a template for system access, according to various implementations of the invention. In some implementations, user interface 300 may be presented that includes an exemplary template for system access. The template for system access may be presented to a user upon initial access of the system. The user interface 300 may include, for example, identification portion 302, navigation bar portion 304, forum portion 306, associated auctions portion 308, new auction portion 310, and/or other portions that display information.

In some implementations, identification portion 302 may display, for example, a user's name and a link via which the user may log out of the system. In some implementations, identification portion 302 may also include a link to the member's profile information, via which the member may view or edit profile information. In some implementations, navigation bar 304 may display one or more links to one or more templates available via the system 10. For example, the navigation bar 304 may display links related to the template for system access, a template for auction access, and/or other templates to present functionality to a member.

In some implementations, forum portion 306 may display a forum in which the member is joined. The forum may be displayed with information relating to the forum, a content feed of the forum, new content shared via the forum, and/or other information relating to the forum.

In some implementations, associated auctions portion 308 may display one or more display components by which the user may view associated auctions, view newly initiated auctions, search for an auction, and/or perform other functionality related to auctions. An individual auction may be displayed with information relating to the auction, a link to access the auction, and/or other information relating to the auction.

In some implementations, new auction portion 310 may display one or more display components by which the member may create an auction. For example, the new auction portion 310 may display one or more input components via which the member may input identification information for an item to be supplied, a minimum bid for the auction, a type of auction to be conducted, and/or other auction identification information related to the auction.

Figure 4:
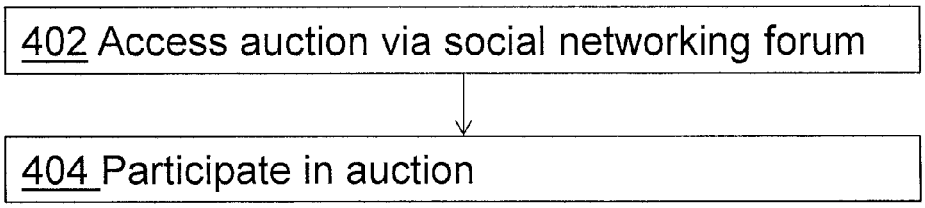
FIG. 4 illustrates a process for participating in an auction conducted via a social networking forum associated with a cohort of users, according to various implementations of the invention.
Figure 5:
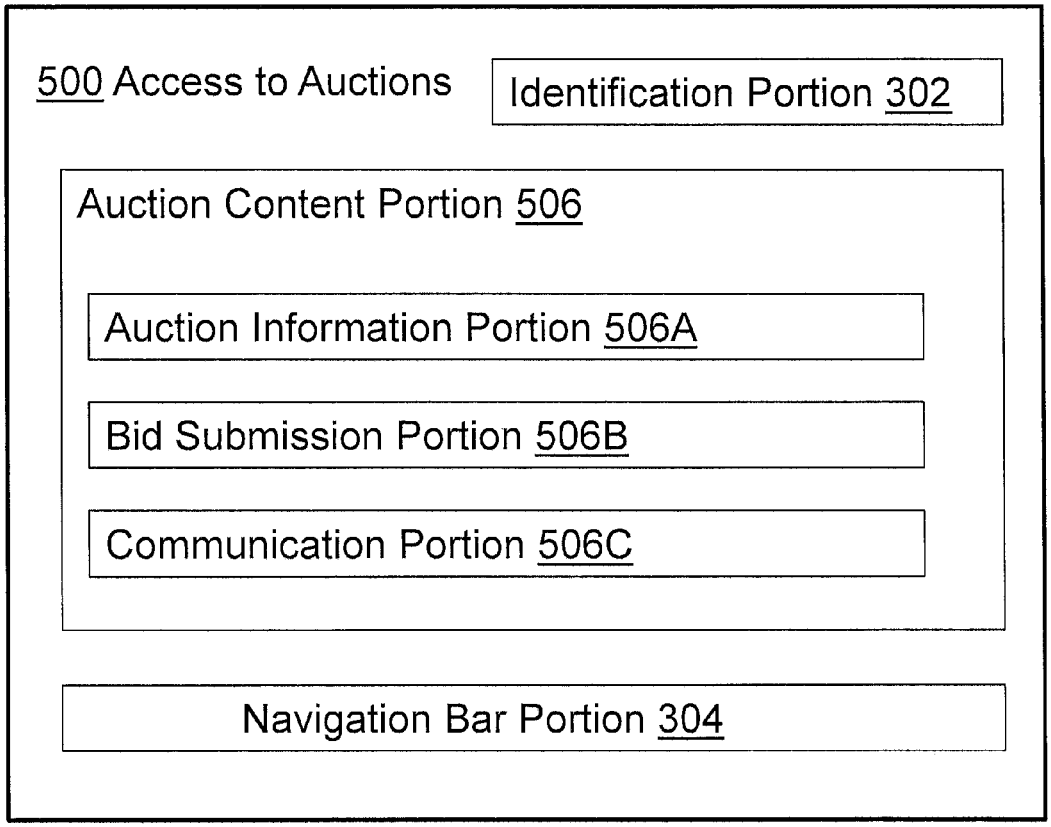
FIG. 5 illustrates an exemplary screenshot of a template by which members of a forum may participate in an auction for an item of content, according to various implementations of the invention.

FIG. 4 illustrates a process for participating in an auction conducted via a social networking forum associated with a cohort of users, according to various implementations of the invention. FIG. 5 illustrates an exemplary screenshot of a template by which members of a forum may participate in an auction for an item of content, according to various implementations of the invention. Processing will be described with respect to FIG. 4 in reference to the screen shots illustrated in FIG. 5.

In an operation 402, one or more members of the forum may access an auction via a social networking forum. The auction management module 130 may facilitate accessing the auction. For example, the auction management module 130 may allow a member to search for an item and facilitate display of auctions related to that item. In another example, the auction management module 130 may facilitate receiving an indication from a member (e.g., by clicking a link related to the auction, and/or other indication) that the member would like to access the auction and may facilitate display of information related to the auction. The auction management module 130 may facilitate accessing the auction by one or more members of the forum in a manner the same or similar to that described above.

In an operation 404, one or more members of the forum may participate in an auction via a social networking forum. The auction management module 130 may facilitate participation by a member of the forum in the auction. The auction management module 130 may facilitate participation in the auction by a member of the forum in a manner the same or similar to that described above.

FIG. 5 illustrates an exemplary screenshot of an interface 500 that includes a template for access to auctions via a social networking forum, according to various implementations of the invention. In some implementations, user interface 500 may be presented that includes an exemplary template for forum access. The template for system access may be presented to a user upon initial access of the system. The user interface 500 may include, for example, identification portion 302, navigation bar portion 304, auction content portion 506, and/or other portions that display information.

In some implementations, auction content portion 506 may display information related to the auction, facilitate submission of bids, facilitate communication between participants in the auction and the supplier, and/or other information related to the auction. For example, forum content portion 506 may comprise one or more sub-portions, including auction information portion 506A, bid submission portion 506B, communication portion 506C, and/or other sub-portions.

In some implementations, auction information portion 506A may display information related to the item for auction, information related to a supplier of the item, information related to parameters of the auction, a predetermined number of bids most recently submitted, a current best bid, a member that submitted the current best bid, and/or other information related to the auction.

In some implementations, bid submission portion 506B may facilitate submission of a bid by a participant in the auction. For example, bid submission portion 506B may comprise one or more user display components that display a current best bid, a member that submitted the current best bid, a "buy now" price for the item, and/or other information related to bidding for the item. The bid submission portion 506B may also comprise one or more user input components configured to receive a bid for the item. For example, the bid submission portion 506B may comprise a user input component via which a member may authorize the system 10 to submit a bid better than the current bid responsive to the member's submitted bid being beaten, until an upper limit for bidding is met.

The communication portion 506C may facilitate social networking communications between participants in the auction. For example, communication portion 506C may display user input components and/or other user components by which a member may post content to the communication portion 506C and/or otherwise engage in social networking communications.

Figure 6:
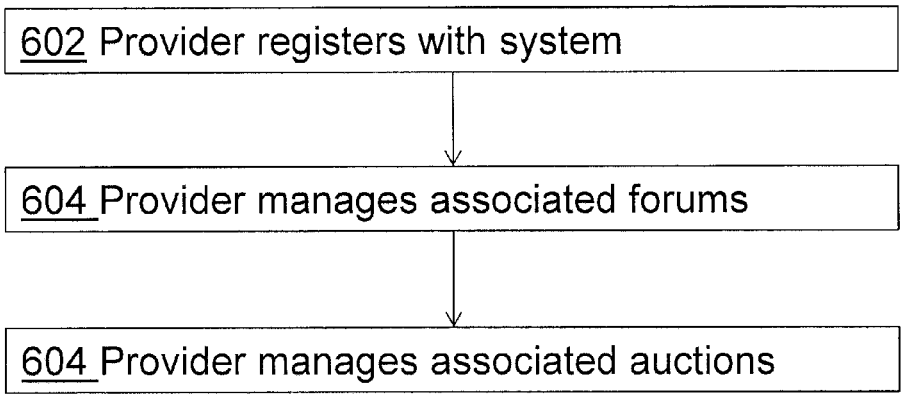
FIG. 6 illustrates a process for conducting an auction via social networking forum for a cohort of users, according to various implementations of the invention.
Figure 7:
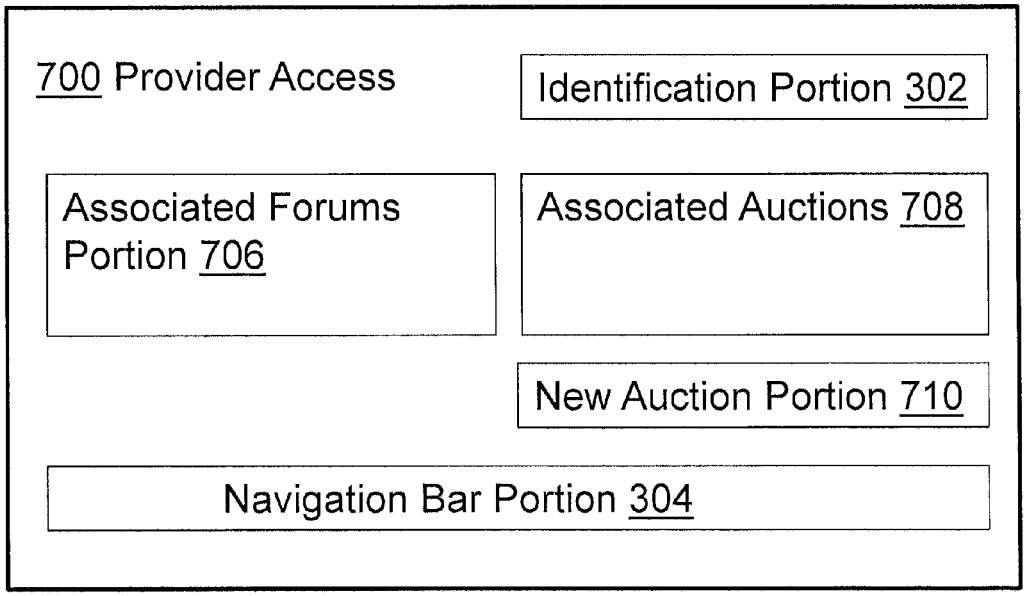
FIG. 7 illustrates an exemplary screenshot of a template by which a provider of a shared experience may participate in an auction for an item of content, according to various implementations of the invention.

FIG. 6 illustrates a process for conducting an auction via social networking forum for a cohort of users, according to various implementations of the invention. FIG. 7 illustrates an exemplary screenshot of a template by which a provider of a shared experience may participate in an auction for an item of content, according to various implementations of the invention. Processing will be described with respect to FIG. 6 in reference to the screen shots illustrated in FIG. 7.

In an operation 602, a provider may register with the system. The provider management module 140 may facilitate registration by the provider. The provider management module 140 may facilitate registration by the provider in a manner the same or similar as that described above.

In an operation 604, a provider may manage associated forums. The provider management module 140 may facilitate management, by the provider, of associated forums. The provider management module 140 may facilitate management, by the provider, of associated forums in a manner the same or similar to that described above.

In an operation 604, a provider may manage associated auctions. The provider management module 140 may facilitate management, by the provider, of associated auctions. The provider management module 140 may facilitate management, by the provider, of associated auctions in a manner the same or similar to that described above.

FIG. 7 illustrates an exemplary screenshot of an interface 800 that includes a template for provider access, according to various implementations of the invention. In some implementations, user interface 700 may be presented that includes an exemplary template for provider access. The template for provider access may be presented to a provider upon initial access of the system. The user interface 700 may include, for example, identification portion 302, navigation bar portion 304, associated forums portion 706, associated auctions portion 708, new auction portion 710, and/or other portions that display information.

In some implementations, associated forums portion 706 may display one or more forums associated with respective one or more cohorts for which the provider provides the shared experience. The forums may be displayed with information relating to the forum, a link to access the forum, new content shared via the forum, functionality provided via the forum, an ability to edit functionality provided via the forum, third parties with access to the forum, an ability to edit third party access to the forum, and/or other information relating to the forum.

In some implementations, associated auctions portion 708 may display one or more display components by which the provider may view associated auctions, view newly initiated auctions, search for an auction, and/or perform other functionality related to auctions. The auctions may be displayed with information relating to the auction, a link to access the auction, and/or other information relating to the auction.

In some implementations, new auction portion 710 may display one or more display components by which the provider may create an auction. For example, the new auction portion 710 may display one or more input components via which the provider may input identification information for an item to be supplied, a minimum bid for the auction, a type of auction to be conducted, and/or other auction identification information related to the auction.

Figure 8:
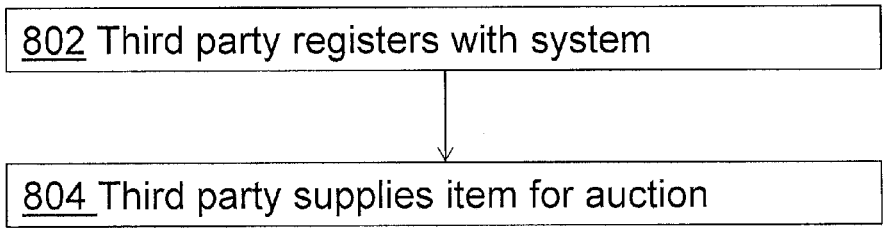
FIG. 8 illustrates a process for conducting an auction via social networking forum for a cohort of users, according to various implementations of the invention.
Figure 9:
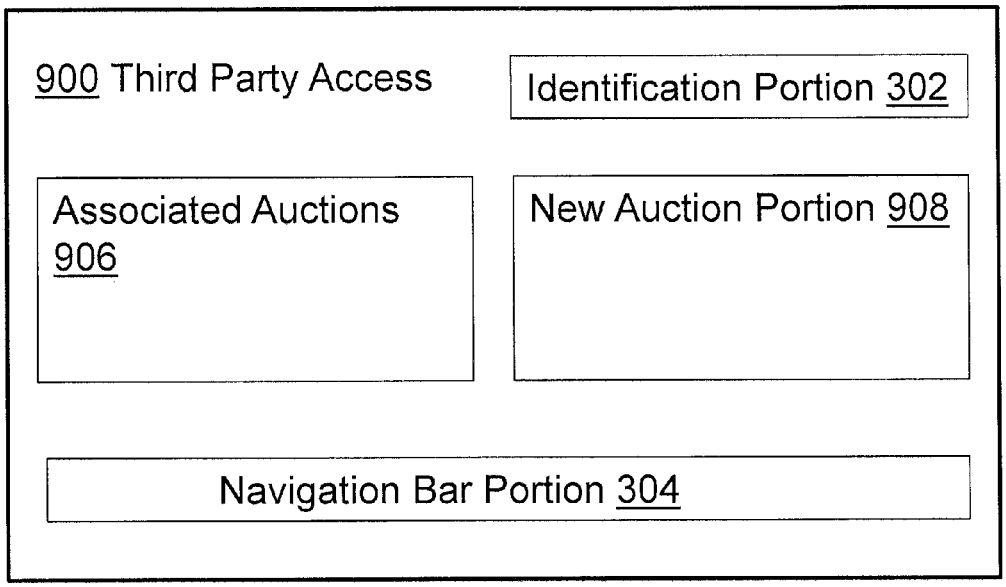
FIG. 9 illustrates an exemplary screenshot of a template by which a third party may participate in an auction for an item of content, according to various implementations of the invention.

FIG. 8 illustrates a process for conducting an auction via social networking forum for a cohort of users, according to various implementations of the invention. FIG. 9 illustrates an exemplary screenshot of a template by which a third party may participate in an auction for an item of content, according to various implementations of the invention. Processing will be described with respect to FIG. 8 in reference to the screen shots illustrated in FIG. 9.

In an operation 802, a third party may register with the system. The third party management module 150 may facilitate registration by the provider. The third party management module 150 may facilitate registration by the third party in a manner the same or similar as that described above.

In an operation 804, a third party may participate in an auction. The third party management module 150 may facilitate participation, by the third party, in an auction. The third party management module 150 may facilitate participation by a third party in an auction in a manner the same or similar to that described above.

FIG. 9 illustrates an exemplary screenshot of an interface 900 that includes a template for third party access, according to various implementations of the invention. In some implementations, user interface 900 may be presented that includes an exemplary template for third party access. The template for third party access may be presented to a third party upon initial access of the system. The user interface 900 may include, for example, identification portion 302, navigation bar portion 304, associated auctions portion 906, new auction portion 908, and/or other portions that display information.

In some implementations, associated auctions portion 906 may display one or more display components by which the third party may view associated auctions, view newly initiated auctions, search for an auction, and/or perform other functionality related to auctions. The auctions may be displayed with information relating to the auction, a link to access the auction, and/or other information relating to the auction.

In some implementations, new auction portion 908 may display one or more display components by which the third party may create an auction. For example, the new auction portion 710 may display one or more input components via which the third party may input identification information for an item to be supplied, a minimum bid for the auction, a type of auction to be conducted, and/or other auction identification information related to the auction.

The computing device 100 may be any computing device such as, for example, a server, a desktop computer, laptop computer, personal digital assistant, smart phone, and/or any other computing device. Other configurations and system architectures may be used. For example, although not shown, computing device 100 may be or include one or more servers connected to one or more clients via a network 20 such as a Wide Area Network, Local Area Network, the Internet, a cloud-based network and/or other network or combination thereof. The computing device 100 may be capable of communicating with network 20, storage module 105 and one or more other devices, such as one or more user computing devices and/or one or more provider computing devices.

A user computing device **30*n* may facilitate communication with the computing device. For example, a user may communicate with the computing device 100 via a user computing device 30*n*. In some implementations, the term user may be interchangeably used herein with the term user computing device. In some implementations, the term member may also be interchangeably used herein with the term user computing device. In some implementations, a user's actions and/or functionality as described herein may be carried out and/or implemented by a user computing device 30*n*. In some implementations, a member's actions and/or functionality as described herein may be carried out and/or implemented by a user computing device 30*n*. The user computing device 30*n* may be any computing device such as, for example, a server, a desktop computer, laptop computer, personal digital assistant, smart phone, and/or any other computing device. The user computing device 30*n* may be capable of communicating with network 20, computing device 100, the storage module 105**, and one or more other devices.

A provider computing device **40*n* may facilitate communication with the computing device 100. For example, a provider may communicate with the computing device 100 via a provider computing device 40*n*. In some implementations, the term provider may be interchangeably used herein with the term provider computing device. In some implementations, a provider's actions and/or functionality as described herein may be carried out and/or implemented by a provider computing device 40***n*. A provider computing device 40*n* may be any computing device such as, for example, a server, a desktop computer, laptop computer, personal digital assistant, smart phone, and/or any other computing device. The provider computing device 40*n* may be capable of communicating with network 20, computing device 100, the storage module 105, and one or more other devices.

The storage module 105 may be at least one database that stores system data such as data related to system usage, one or more cohorts, one or more forums, one or more auctions, third parties, and/or or any other data. The storage module 105 may be associated and communicate with the computing device 100.

The one or more databases comprising the storage module 105 may be, include, or interface to, for example, an Oracle™ relational database sold commercially by Oracle Corporation. Other databases, such as Informix™, DB2 (Database 2) or other data storage, including file-based, object, or query formats, platforms, or resources such as OLAP (On Line Analytical Processing), SQL (Standard Query Language), NoSQL, a SAN (storage area network), Microsoft Access™ or other form of database may also be used, incorporated, or accessed. The database may comprise one or more such databases that reside in one or more physical devices and in one or more physical locations. The database may store a plurality of types of data and/or files and associated data or file descriptions, administrative information, or any other data.

In some implementations, the storage module 105 may be part of or hosted by a computing device on the network 20. In some implementations, the storage module 105 may be part of or hosted by the computing device 100. In some implementations, the storage module 105 may be physically separate from the computing device 100 but may be operably communicable therewith.

In some implementations, the storage module 105 may comprise electronic storage media that electronically stores information. The storage module 105 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The storage module 105 may include one or more virtual storage resources (e.g., cloud storage, a virtual private network, and/or other virtual storage resources). The storage module 105 may store software algorithms, information determined by processor 101, information received from computing device 100, information received from user computing devices 30*a*, 30*b*, . . . 30*n*, information received from provider computing devices 40*a*, 40*b*, . . . 40*n*, information received from third parties, and/or other information that enables computing device 100 to function as described herein.

Processor(s) 101 is configured to provide information processing capabilities in computing device 100. As such, processor 101 may include one or more of a digital processor, an analog processor, a digital circuit designed to process information, an analog circuit designed to process information, a state machine, and/or other mechanisms for electronically processing information. Although processor 101 is shown in FIG. 1 as a single entity, this is for illustrative purposes only. In some implementations, processor 101 may include a plurality of processing units. These processing units may be physically located within the same device, or processor 101 may represent processing functionality of a plurality of devices operating in coordination. The processor 101 may be configured to execute modules 110, 120, 130, 140, 150, 160, 170, and/or 199. Processor 101 may be configured to execute modules 110, 120, 130, 140, 150, 160, 170, and/or 199 by software; hardware; firmware; some combination of software, hardware, and/or firmware; and/or other mechanisms for configuring processing capabilities on processor 101.

It should be appreciated that although modules 110, 120, 130, 140, 150, 160, 170, and/or 199 are illustrated in FIG. 1 as being co-located within a single processing unit, in implementations in which processor 101 includes multiple processing units, one or more of modules 110, 120, 130, 140, 150, 160, 170, and/or 199 may be located remotely from the other modules. The description of the functionality provided by the different modules 110, 120, 130, 140, 150, 160, 170, and/or 199 described below is for illustrative purposes, and is not intended to be limiting, as any of modules 110, 120, 13, 140, 150, 160, 170, and/or 199 may provide more or less functionality than is described. For example, one or more of modules 110, 120, 130, 140, 150, 160, 170, and/or 199 may be eliminated, and some or all of its functionality may be provided by other ones of modules 110, 120, 130, 140, 150, 160, 170, and/or 199. As another example, processor 101 may be configured to execute one or more additional modules that may perform some or all of the functionality attributed below to one of modules 110, 120, 130, 140, 150, 160, 170, and/or 199.

In addition, implementations of the invention may be made in hardware, firmware, software, or any suitable combination thereof. Aspects of the invention may also be implemented as instructions stored on a machine-readable medium, which may be read and executed by one or more processors. A machine-readable medium may include any mechanism for storing or transmitting information in a form readable by a machine (e.g., a computing device). For example, a tangible computer readable storage medium may include read only memory, random access memory, magnetic disk storage media, optical storage media, flash memory devices, and others, and a machine-readable transmission media may include forms of propagated signals, such as carrier waves, infrared signals, digital signals, and others. Further, firmware, software, routines, or instructions may be described herein in terms of specific exemplary aspects and implementations of the invention, and performing certain actions. However, it will be apparent that such descriptions are merely for convenience and that such actions in fact result from computing devices, processors, controllers, or other devices executing the firmware, software, routines, or instructions.

Aspects and implementations described herein as including a particular feature, structure, or characteristic, but every aspect or implementation may not necessarily include the particular feature, structure, or characteristic. Further, when a particular feature, structure, or characteristic is described in connection with an aspect or implementation, it will be understood that such feature, structure, or characteristic may be included in connection with other aspects or implementations, whether or not explicitly described. Thus, various changes and modifications may be made to the provided description without departing from the scope or spirit of the invention. As such, the specification and drawings should be regarded as exemplary only, and the scope of the invention to be determined solely by the appended claims.

What is claimed is:

1. A system for conducting an online auction via a social networking forum for a cohort of users, the system comprising:

one or more physical processors programmed with computer readable instructions to:

obtain information related to a first cohort prior to creating a social networking forum for users of the first cohort, the first cohort comprising a plurality of users that have a pre-established association with a first experience scheduled to occur at a first time, a first date, and a first location, the information related to the first cohort comprising information related to the first experience and a provider of the first experience;

receive a request from a first user of the first cohort to join a social networking forum for users of the first cohort;

provide the social networking forum for users of the first cohort responsive to receiving the request, wherein one or more users of the first cohort join the social networking forum as respective one or more members of the social networking forum;

share information from the one or more members of the social networking forum via a content feed of the social networking forum;

receive first auction information related to a first item for auction, the first auction information comprising: a first item identifier for the first item, a first minimum bid for the first item, and a first supplier identifier of a supplier of the first item;

associate a subset of the one or more members of the social networking forum as participants in a first auction for the first item; and conduct the first auction for the first item, wherein conducting the first auction comprises performing one or more auction events and ending the first auction upon occurrence of the first experience.

2. The system of claim 1, wherein an auction event comprises: notifying the participants of the first auction that the first item is available for auction, notifying the participants of the first auction that one or more bids for the first auction were received, ending the first auction, or awarding the first item to a winning bidder.

3. The system of claim 1, wherein the first auction information comprises an end condition for the first auction, which, when satisfied, indicates that the first auction should end, and wherein the one or more physical processors are programmed with computer readable instructions to end the first auction when the end condition for the first auction is satisfied.

4. The system of claim 3, wherein the end condition comprises: a predetermined amount of time passing after the first auction begins, occurrence of the first experience, or a predetermined time passing after a bid was received from a participant of the first auction.

5. The system of claim 1, wherein the one or more physical processors are programmed with computer readable instructions to display, for the first auction, information related to conducting the first auction, the information related to conducting the first auction comprising one or more of: the first item identifier, the first supplier identifier, a time until the first auction ends, the minimum bid, a current bid, or a price at which the first item may be directly bought.

6. The system of claim 5, wherein the one or more physical processors are programmed with computer readable instructions to display the information related to conducting the first auction via a communication channel separately from the content feed of the social networking forum.

7. The system of claim 6, wherein the one or more physical processors are programmed with computer readable instructions to:

receive communication from a first participant in the first auction; and output the communication to a second participant in the first auction via the communication channel.

8. The system of claim 1, wherein the one or more physical processors are programmed with computer readable instructions to:

register a first provider who provides the first experience, the first provider comprising an entity that provides the first experience for participation by users of the first cohort and makes available the information related to the first experience;

receive the first auction information from the first provider; and conduct the first auction with the first item from the first provider based on the received first auction information, wherein the supplier comprises the first provider.

9. The system of claim 8, wherein the one or more physical processors are programmed with computer readable instructions to:

receive, from the first provider, one or more restrictions related to conducting an auction via the social networking forum, the one or more restrictions comprising: a restriction as to what items may be supplied, a type of item that may be supplied, a type of supplier, or a time and date of the auction; and restrict the first auction based on the received one or more restrictions.

10. The system of claim 1, wherein the one or more physical processors are programmed with computer readable instructions to:

manage access of a third party to the social networking forum;

receive the first auction information from the third party; and conduct the first auction with the first item from the third party based on the received first auction information, wherein the supplier comprises the third party.

11. A computer implemented method for conducting an online auction via a social networking forum for a cohort of users, the method being implemented in a computer system comprising one or more physical processors programmed with computer readable instructions, the method comprising:

obtaining, by the one or more physical processors, information related to a first cohort prior to creating a social networking forum for users of the first cohort, the first cohort comprising a plurality of users that have a pre-established association with a first experience scheduled to occur at a first time, a first date, and a first location, the information related to the first cohort comprising information related to the first experience and a provider of the first experience;

receiving, by the one or more physical processors, a request from a first user of the first cohort to join a social networking forum for users of the first cohort;

providing, by the one or more physical processors, the social networking forum for users of the first cohort responsive to receiving the request, wherein one or more users of the first cohort join the social networking forum as respective one or more members of the social networking forum; and sharing, by the one or more physical processors, information from the one or more members of the social networking forum via a content feed of the social networking forum;

receiving, by the one or more physical processors, first auction information related to a first item for auction, the first auction information comprising: a first item identifier for the first item, a first minimum bid for the first item, and a first supplier identifier of a supplier of the first item;

associating, by the one or more physical processors, a subset of the one or more members of the social networking forum as participants in a first auction for the first item; and conducting, by the one or more physical processors, the first auction for the first item, wherein conducting the first auction comprises performing one or more auction events and ending the first auction upon occurrence of the first experience, and wherein the first auction is different from the first experience.

12. The method of claim 11, wherein an auction event comprises: notifying the participants of the first auction that the first item is available for auction, notifying the participants of the first auction that one or more bids for the first auction were received, ending the first auction, or awarding the first item to a winning bidder.

13. The method of claim 11, wherein the first auction information comprises an end condition for the first auction, which, when satisfied, indicates that auction should end, and wherein the method further comprises:

ending, by the one or more physical processors, the first auction when the end condition for the first auction is satisfied.

14. The method of claim 13, wherein the end condition comprises: a predetermined amount of time passing after the first auction begins, occurrence of the first experience, or a predetermined time passing after a last bid was received from a participant in the first auction.

15. The method of claim 11, further comprising:

displaying, by the one or more physical processors, for the first auction, information related to conducting the first auction, the information related to conducting the first auction comprising one or more of: the first item identifier, the first supplier identifier, a time until the first auction ends, the minimum bid, a current bid; or a price at which the first item may be directly bought.

16. The method of claim 15, further comprising:

displaying, by the one or more physical processors, the information related to conducting auction via a communication channel separate from the content feed of the social networking forum.

17. The method of claim 11, further comprising:

receiving, by the one or more physical processors, communication from a first participant in the first auction; and outputting, by the one or more physical processors, the communication to a second participant in the first auction via the communication channel.

18. The method of claim 11, further comprising:

registering, by the one or more physical processors, a first provider that provides the first experience, the first provider comprising an entity that provides the first experience for participation by users of the first cohort and makes available the information related to the first experience;

receiving, by the one or more physical processors, the first auction information from the first provider; and conducting, by the one or more physical processors, the first auction with the first item from the first provider based on the received first auction information, wherein the supplier comprises the first provider.

19. The method of claim 18, further comprising:

receiving, by the one or more physical processors, from the first provider, one or more restrictions related to conducting an auction via the social networking forum, the one or more restrictions comprising: a restriction as to what items may be supplied, a type of item that may be supplied, a type of supplier, or a time and date of the auction; and restricting, by the one or more physical processors, the first auction based on the one or more restrictions.

20. The method of claim 11, further comprising:

managing, by the one or more physical processors, access of a third party to the social networking forum;

receiving, by the one or more physical processors, the first auction information from the third party; and conducting, by the one or more physical processors, the first auction with the first item from the third party based on the received first auction information, wherein the supplier comprises the third party.

21. A system for conducting an online auction via a social networking forum for a cohort of users, the system comprising:

one or more physical processors programmed with computer readable instructions to:

register a first provider who provides a first experience scheduled to occur at a first time, a first date, and a first location, the first provider comprising an entity that provides the first experience for participation by users of a first cohort and makes available information related to the first experience;

provide a social networking forum for users of the first cohort, the first cohort comprising a plurality of users that have a pre-established association with the first experience, wherein one or more users of the first cohort join the social networking forum as respective one or more members of the social networking forum;

share information from the one or more members of the social networking forum via a content feed of the social networking forum;

receive, from the first provider, first auction information related to a first item for auction, the first auction information comprising: a first item identifier for the first item, a first minimum bid for the first item, and a first supplier identifier comprising information regarding a supplier of the first item;

associate a subset of the one or more members of the social networking forum as participants in a first auction for the first item;

conduct the first auction for the first item, wherein conducting the first auction comprises performing one or more auction events and ending the first auction upon occurrence of the first experience, and wherein the first auction is different from the first experience;

receive, from the first provider, information related to restricting participation by one or more participants in the first auction; and manage participation by the one or more participants in the first auction based on the received information related to restricting participation by the one or more participants.

22. The system of claim 21, wherein an auction event comprises: notifying the participants of the first auction that the first item is available for auction, notifying the participants of the first auction that one or more bids for the first auction were received, ending the first auction, or awarding the first item to a winning bidder.

23. The system of claim 21, wherein the one or more physical processors are programmed with computer readable instructions to:

receive, from the first provider, an end condition for the first auction, which, when satisfied, indicates that the first auction should end, wherein the end condition comprises: a predetermined amount of time passing after the first auction begins, occurrence of the first experience, or a predetermined time passing after a bid was received from a participant of the first auction; and end the first auction when the end condition for the first auction is satisfied.

24. The system of claim 23, wherein the one or more physical processors are programmed with computer readable instructions to manage participation by the one or more participants in the first auction by:

receiving, from the first provider, one or more restrictions related to conducting the first auction, the one or more restrictions comprising: a restriction as to what items may be supplied, a type of item that may be supplied, a type of supplier, or a time and date of the first auction; and restricting the first auction based on the one or more restrictions.

25. The system of claim 24, wherein the one or more physical processors are programmed with computer readable instructions to manage participation by the one or more participants in the first auction by:

receiving information related to access of the social networking forum for a third party;

providing access to the third party to the social networking forum based on the received information related to the access of the social networking forum for the third party; and controlling participation of the third party in the first auction based on the received information related to the access of the social networking forum for the third party.

26. A computer implemented method for conducting an online auction via a social networking forum for a cohort of users, the method being implemented in a computer system comprising physical processors programmed with computer readable instructions, the method comprising:

registering, by the one or more physical processors, a first provider who provides a first experience scheduled to occur at a first time, a first date, and a first location, the first provider comprising an entity that provides the first experience for participation by users of a first cohort and makes available the information related to the first experience;

providing, by the one or more physical processors, a social networking forum for users of the first cohort, the first cohort comprising a plurality of users that have a pre-established association with the first experience, wherein one or more users of the first cohort join the social networking forum as respective one or more members of the social networking forum; and sharing, by the one or more physical processors, information from the one or more members of the social networking forum via a content feed of the social networking forum;

receiving, by the one or more physical processors, from the first provider, first auction information related to a first item for auction, the first auction information comprising: a first item identifier for the first item, a first minimum bid for the first item, and a first supplier identifier of a supplier of the first item;

associating, by the one or more physical processors, a subset of the one or more members of social networking the forum as participants in a first auction for the first item;

conducting, by the one or more physical processors, the first auction for the first item, wherein conducting the first auction comprises performing one or more auction events and ending the first auction upon occurrence of the first experience, and wherein the first auction is different from the first experience;

receiving, by the one or more physical processors, information from the first provider related to restricting participation by one or more participants in the first auction; and managing, by the one or more physical processors, participation by the one or more participants in the first auction based on the received information related to restricting participation by the one or more participants.

27. The method of claim 26, wherein an auction event comprises:

notifying the participants of the first auction that the first item is available for auction, notifying the participants of the first auction that one or more bids for the first auction were received, ending the first auction, or awarding the first item to a winning bidder.

28. The method of claim 26, further comprising:

receiving, by the one or more physical processors, from the first provider, an end condition for the first auction, which, when satisfied, indicates that the first auction should end, wherein the end condition comprises: a predetermined amount of time passing after the first auction begins, occurrence of the first experience, or a predetermined time passing after a bid was received from a participant of the first auction; and ending, by the one or more physical processors, the first auction when the end condition for the first auction is satisfied.

29. The method of claim 28, wherein managing, by the one or more physical processors, participation by the one or more participants in the first auction comprises:

receiving, by the one or more physical processors, from the first provider, one or more restrictions related to conducting the first auction, the one or more restrictions comprising: a restriction as to what items may be supplied, a type of item that may be supplied, a type of supplier, or a time and date of the first auction; and restricting, by the one or more physical processors, the first auction based on the one or more restrictions.

30. The method of claim 29, wherein managing, by the one or more physical processors, participation by the one or more participants in the first auction comprises:

receiving, by the one or more physical processors, information related to access of the social networking forum for a third party;

providing, by the one or more physical processors, access to the third party to the social networking forum based on the received information related to the access of the social networking forum for the third party; and controlling, by the one or more physical processors, participation of the third party in the first auction based on the received information related to the access of the social networking forum for the third party.

* * * * *